US008535480B2

(12) United States Patent
Leite

(10) Patent No.: US 8,535,480 B2
(45) Date of Patent: Sep. 17, 2013

(54) METHOD AND SYSTEM FOR PULP PROCESSING USING COLD CAUSTIC EXTRACTION WITH ALKALINE FILTRATE REUSE

(75) Inventor: Marcelo Moreira Leite, Salvado (BR)

(73) Assignee: Bahia Specialty Cellulose SA (BR)

( * ) Notice: Subject to any disclaimer, the term of this patent is extended or adjusted under 35 U.S.C. 154(b) by 311 days.

(21) Appl. No.: 12/789,265

(22) Filed: May 27, 2010

(65) Prior Publication Data

US 2011/0272109 A1 Nov. 10, 2011

(30) Foreign Application Priority Data

May 6, 2010 (KR) ..... 10-2010-0042681

(51) Int. Cl.
*D21H 11/16* (2006.01)
*D21C 9/00* (2006.01)

(52) U.S. Cl.
USPC ..... 162/33; 162/29; 162/157.7

(58) Field of Classification Search
USPC ..... 162/29, 50
See application file for complete search history.

(56) References Cited

U.S. PATENT DOCUMENTS

| | | | |
|---|---|---|---|
| 3,148,106 | A | 9/1964 | Mitchell et al. |
| 3,988,198 | A | 10/1976 | Wilson et al. |
| 4,507,172 | A | 3/1985 | Steltemkamp |
| 5,053,108 | A | 10/1991 | Richter |
| 5,080,755 | A | 1/1992 | Backlund |
| 5,382,321 | A | 1/1995 | Fagerlind et al. |
| 5,589,033 | A | 12/1996 | Tikka et al. |
| 5,674,359 | A | 10/1997 | Chasse et al. |
| 5,676,795 | A | 10/1997 | Wizani et al. |
| 5,830,314 | A | 11/1998 | Mattsson |
| 6,057,438 | A | 5/2000 | Hyatt et al. |
| 6,086,712 | A | 7/2000 | Marcoccia et al. |
| 6,139,689 | A | 10/2000 | Polston et al. |
| 6,248,208 | B1 | 6/2001 | Henricson et al. |
| 6,346,167 | B2 | 2/2002 | Marcoccia et al. |
| 6,348,129 | B1 | 2/2002 | Colodette et al. |
| 6,506,283 | B2 | 1/2003 | Henricson et al. |
| 6,512,110 | B1 | 1/2003 | Heikkila et al. |
| 6,533,896 | B1 | 3/2003 | Tikka et al. |

(Continued)

FOREIGN PATENT DOCUMENTS

| | | |
|---|---|---|
| EP | 0442806 | 8/1991 |
| EP | 0810321 | 12/1997 |

(Continued)

OTHER PUBLICATIONS

Grace editor, Pulp and Paper Manufacture: Alkaline Pulping, 1989, The Joint Textbook Committee of the Paper Industry, vol. 5 3rd edition, p. 101-103, 122, 502-511.*

(Continued)

*Primary Examiner* — Anthony Calandra
(74) *Attorney, Agent, or Firm* — Irell & Manella LLP

(57) ABSTRACT

A method for pulp processing includes a cold caustic extraction stage in which the spent cold caustic solution and the spent liquid used to wash the extracted pulp are concentrated by an evaporation system. The concentrated liquid can be used as part of the neutralization and cooking liquor in the pulp process, leading to increased efficiency without significant reduction in pulp quality. Highly concentrated filtrate from the cold caustic extraction stage may help reduce hemicellulose deposition on wood fiber during the cooking step.

40 Claims, 5 Drawing Sheets

(56) References Cited

U.S. PATENT DOCUMENTS

| | | | | |
|---|---|---|---|---|
| 6,835,828 | B2 | 12/2004 | Sears et al. | |
| 6,896,810 | B2 | 5/2005 | Ali et al. | |
| 7,056,418 | B2 | 6/2006 | Andoh et al. | |
| 7,285,184 | B2 | 10/2007 | Li et al. | |
| 7,670,678 | B2 | 3/2010 | Phan | |
| 2002/0017370 | A1 | 2/2002 | Henricson et al. | |
| 2002/0096276 | A1 * | 7/2002 | Leithem et al. | 162/90 |
| 2004/0020854 | A1 | 2/2004 | Ali et al. | |
| 2005/0203291 | A1 | 9/2005 | Svenson et al. | |
| 2006/0070710 | A1 | 4/2006 | Hernesniemi et al. | |
| 2009/0038033 | A1 | 2/2009 | Bloksberg et al. | |
| 2009/0312536 | A1 * | 12/2009 | Sixta et al. | 536/60 |

FOREIGN PATENT DOCUMENTS

| | | |
|---|---|---|
| EP | 1052326 | 11/2000 |
| JP | 2000220086 | 8/2000 |
| NZ | 215474 | 9/1986 |
| NZ | 223929 | 3/1990 |
| NZ | 236941 | 10/1993 |
| NZ | 237098 | 1/1994 |
| NZ | 243912 | 2/1994 |
| NZ | 242356 | 6/1994 |
| NZ | 278098 | 1/1998 |
| NZ | 314898 | 6/1998 |
| WO | 9520065 | 7/1995 |
| WO | 9523891 | 9/1995 |
| WO | 9532331 | 11/1995 |
| WO | 0236876 | 5/2002 |
| WO | 0242551 | 5/2002 |
| WO | 03057979 | 7/2003 |
| WO | 2005064075 | 7/2005 |
| WO | 2006037860 | 4/2006 |
| WO | 2009013600 | 1/2009 |
| WO | 2009136000 | 1/2009 |

OTHER PUBLICATIONS

PCT International Search Report, mailed Apr. 4, 2011, PCT Patent Appin No. PCT/IB2010/002244.

U.S. Congress, Office of Technology Assessment, "Technologies for Reducing Dioxin in the Manufacture of Bleached Wood Pulp", OTA-BP-O-54 (Washington, D.C.; U.S. Government Printing Office, May 1989).

U.S. Congress, Office of Technology Assessment, Technologies for Reducing Dioxin in the Manufacture of Bleached Wood Pulp, OTA-BP-O-54 (Washington, DC: U.S. Government Printing Office, May 1989).

PCT International Preliminary Report on Patentabilty, mailed Jul. 13, 2012. PCT Patent Appin. No. PCT/IB2010/002244.

* cited by examiner

METHOD AND SYSTEM FOR PULP PROCESSING USING COLD CAUSTIC EXTRACTION WITH ALKALINE FILTRATE REUSE

BACKGROUND OF THE INVENTION

1) Field of the Invention

The field of the invention generally relates to pulp processing and, more specifically, to an improved method and system for treating effluents from cold caustic extraction in connection with a kraft chemical pulping process.

2) Background

Pulp from wood and plant materials has a large number of commercial uses. Although one of the most common uses is in paper manufacturing, pulp can also be used to produce a number of other products including rayon and other synthetic materials, as well as cellulose acetate and cellulose esters, which are used, for example, in the manufacture of filter tow, cloth, packaging films, and explosives.

A number of chemical and mechanical methods exist for processing wood and plant materials in order to manufacture pulp and paper. The basic processing steps include preparing the raw material (e.g., debarking and chipping), separating the wood fibers by mechanical or chemical means (e.g., grinding, refining or cooking) to separate the lignin and extractives from cellulose of the wood fibers, removing coloring agents by bleaching, and forming the resulting processed pulp into paper or other products. In addition to and in connection with pulp and paper manufacturing, paper mills also typically have facilities to produce and reclaim chemical agents, collect and process by-products to produce energy, and remove and treat wastes to minimize environmental impact.

"Pulping" generally refers to the process for achieving fiber separation. Wood and other plant materials comprise cellulose, hemicellulose, lignin and other minor components. Lignin is a network of polymers interspersed between individual fibers, and functions as an intercellular adhesive to cement individual wood fibers together. During the pulping process, lignin macromolecules are fragmented, thereby liberating the individual cellulosic fibers and dissolving impurities that may cause discoloration and future disintegration of the paper or other final product.

The kraft process is a commonly used pulping process. Paper produced from kraft pulping process can be used, for example, to make bleached boxboard and liner board used in the packaging industry. A conventional kraft process treats wood with an aqueous mixture of sodium hydroxide and sodium sulfide, known as "white liquor". The treatment breaks the linkage between lignin and cellulose, and degrades most of lignin and a portion of hemicellulose macromolecules into fragments that are soluble in strongly basic solutions. This process of liberating lignin from surrounding cellulose is known as delignification. The soluble portion is thereafter separated from the cellulose pulp.

FIG. 1 shows a flow diagram of a conventional kraft process 100. The process 100 involves feeding wood chips (or other organic pulp-containing raw materials) 118 and alkaline solutions into a high-pressure reaction vessel called a digester to effect delignification, in what is referred to as a "cooking" stage 121. The wood chips are combined with white liquors 111, which may be generated from downstream processes or provided from a separate source. Delignification may take several hours and the degree of delignification is expressed as the unitless "H factor", which is generally defined so that cooking for one hour in 100° C. is equivalent to an H factor of 1. Because of the high temperature, the reaction vessel is often pressurized due to the introduction of steam. Towards the end of the cooking step, the reaction vessel is reduced to atmospheric pressure, thereby releasing steam and volatiles.

The white liquor used in the cooking may be, for example, a caustic solution containing sodium hydroxide (NaOH) and sodium sulfide ($Na_2S$). The property of the white liquor is often expressed in terms of effective alkali ("EA") and sulfidity. Effective alkali concentration may be calculated as the weight of sodium hydroxide plus one-half the weight of sodium sulfide, and represents the equivalent weight of sodium hydroxide per liter of liquor, expressed in gram per liter. Effective alkali charge as sodium hydroxide represents the equivalent weight of sodium hydroxide per oven-dried weight of wood, expressed in percentage. Sulfidity is the ratio of one-half the weight of sodium sulfide to the sum of the weight of sodium hydroxide and one-half the weight of sodium sulfide, expressed in percentage.

After cooking, a brown solid cellulosic pulp, also known as "brown stock," is released from the digester used in the cooking stage 121, and is then screened and washed in the washing and screening process 122. Screening separates the pulp from shives (bundles of wood fibers), knots (uncooked chips), dirt and other debris. Materials separated from the pulp are sometimes referred to as the "reject" and the pulp as the "accept." Multi-stage cascade operations are often utilized to reduce the amount of cellulosic fibers in the reject stream while maintaining high purity in the accept stream. Further fiber recovery may be achieved through a downstream refiner or reprocess of sieves and knots in the digester.

The brown stock may then be subject to several washing stages in series to separate the spent cooking liquors and dissolved materials from the cellulose fibers. The spent cooking liquor 112 from the digester employed in the cooking stage 121 and the liquor 113 collected from the washing and screening process 122 are commonly both referred to as "black liquor" because of their coloration. Black liquor generally contains lignin fragments, carbohydrates from the fragmented hemicelluloses, and inorganics. Black liquor may be used in addition to white liquor in the cooking step, as illustrated for example in FIG. 1 by the arrow representing black liquor 113 produced in the washing and screening process 122 and transferred to the cooking stage 121. Black liquor 135 from an accumulator tank (not shown in FIG. 1) may also be fed to the digester as part of the cooking stage 121, if needed to achieve the appropriate alkaline concentration or for other similar purposes.

The cleaned brown stock pulp 131 from the washing and screening process 122 may then be blended with white liquor 114 and fed into a reaction vessel to further remove dissolved materials such as hemicellulose and low molecular weight cellulose. An exemplary separation method is the so-called cold caustic extraction ("CCE") method, and is represented by CCE reaction stage 123 in FIG. 1. The temperature at which the extraction is effected may vary but is typically less than 60° C.

The purified pulp 132 from the reactor used in the CCE reaction stage 123 is then separated from spent cold caustic solution and dissolved hemicellulose, and washed several times in a second washing and separation unit in a CCE washing stage 124. The resulting purified brown pulp 133 with relatively high alpha cellulose content, still containing some lignin, continues to a downstream bleaching unit for further delignification. In some pulp production processes, bleaching is performed before the CCE reaction stage 123 and the CCE washing stage 124.

It is desirable in a number of applications, such as the manufacture of synthetic materials or pharmaceutical products, to have pulp of very high purity or quality. Pulp quality can be evaluated by several parameters. For example, the percentage of alpha cellulose content expresses the relative purity of the processed pulp. The degrees of delignification and cellulose degradation are measured by Kappa Number ("KN") and pulp viscosity respectively. A higher pulp viscosity indicates longer cellulose chain length and lesser degradation. Pulp solubility in 18 wt % sodium hydroxide aqueous solutions ("S18") provides an estimate on the amount of residual hemicellulose. Pulp solubility in 10 wt % sodium hydroxide aqueous solution ("S10") provides an indication on the total amounts of soluble matters in basic solutions, which include the sum of hemicellulose and degraded cellulose. Finally, the difference between S10 and S18 determines the amount of degraded cellulose.

In a conventional process, the filtrate 116, also referred to as the CCE alkaline filtrate, from the CCE washing and separation stage 124 comprises both the spent cold caustic solution and the spent washing liquid from the washing and separation stage 124. This filtrate 116 often contains substantial amounts of high molecular hemicellulose. When filtrate with high hemicellulose content is used as part of the cooking liquor in the digester of the cooking stage 121, hemicellulose may precipitate out of the solution and deposit on the cellulosic fibers. This can prevent high quality pulp from being achieved. On the other hand, certain applications—such as high quality yarn or synthetic fabrics, materials for liquid crystal displays, products made with acetate derivatives, viscose products (such as tire cord and special fibers), filter tow segments used in cigarettes, and certain food and pharmaceutical applications—desire pulps containing a minimal amount of redeposited hemicelluloses and alpha cellulose content.

Some portion of the CCE alkaline filtrate 116 may be reused in the cooking stage 121, while the remainder is sent to a recovery area 134 in order to control the risk of hemicelluloses redeposition in the cooking stage 121. In the recovery area 134, the diverted CCE alkaline filtrate 116 may be combined with excess black liquor, concentrated and combusted in a recovery boiler to consume the organics and recover inorganic salts, or else was taken to another pulping line, or a combination of both. A new alkali source may then be needed to replace the CCE filtrate and black liquor sent to the recovery area 134, in order to maintain proper alkali balance in the cooking stage 121. The recovery process and the provision of a new alkali source tends to result in increased production costs.

There exists a need for a pulp processing method and system that results in a dissolving pulp with very high alpha cellulose content. There further exists a need for a pulp processing method and system that provides increased efficiency and permits efficient use of the CCE filtrate while minimizing hemicellulose deposition during cooking.

SUMMARY OF THE INVENTION

In one aspect, an improved method and system for pulp manufacturing involves, among other things, washing purified pulp yielded from a cold caustic extraction process, collecting an alkaline filtrate resulting therefrom, concentrating the alkaline filtrate by, e.g., evaporation, and utilizing at least a portion of the concentrated alkaline filtrate in an upstream cooking process.

According to one or more embodiments, a method and system for pulp manufacturing using cold caustic extraction in conjunction with a kraft process includes the steps of delignifying organic pulp-containing materials in a digester, treating a resulting brown stock to yield semi-purified pulp, extracting the semi-purified pulp with a caustic solution to yield a purified pulp and a solution containing hemicellulose, separating the hemicellulose-containing solution from the purified pulp, washing the purified pulp and collecting an alkaline filtrate resulting therefrom, concentrating the alkaline filtrate, and utilizing at least a portion of the concentrated alkaline filtrate in the digester. The concentrated alkaline filtrate may gradually replace a different cooking liquor that is initially used to start up the cooking process, thereby resulting in increased efficiency.

In certain embodiments, an alkaline filtrate is concentrated to form a solution containing, for example, 90 grams or more per liter of effective alkali as sodium hydroxide. By utilizing the concentrated alkaline filtrate as part of the cooking liquor, the purity of the brown stock and resulting purified pulp may be enhanced.

Further embodiments, alternatives and variations are also described herein or illustrated in the accompanying figures.

DETAILED DESCRIPTION OF PREFERRED EMBODIMENTS

According to one or more embodiments, a method and system for pulp processing involves combining a first caustic solution, such as white liquor, with a quantity of wood or other organic material containing raw pulp in an appropriate tank or vessel (a digester) for cooking at a suitable temperature of, e.g., between 130 and 180° C. to yield a brown stock. Washing and screening of the brown stock results in semi-purified pulp as well as derivatives (such as black liquor) that are fed back to the digester. The semi-purified pulp may be extracted with another caustic solution (which again may be white liquor) at a suitable temperature of, e.g., below 60° C. to yield a purified pulp. Through additional washing, a hemicellulose-containing solution may be separated from the purified pulp, resulting in another caustic solution in the form of an alkaline filtrate that can be separately collected and stored. This alkaline filtrate may be concentrated by, e.g., evaporation or other means, and used by itself or in combination with the first caustic solution in the digester to treat the organic materials and re-start the cycle.

According to an aspect of one or more embodiments, wood chips or other pulp-containing organics are reacted with a caustic solution in a reaction vessel. At the end of the reaction, the reaction mixture contains liberated cellulosic fibers. These fibers are further extracted with a second caustic solution to dissolve hemicellulose. The spent caustic solution together with dissolved hemicellulose is separated from the extracted pulp, and the pulp is subject to further washing to remove residual caustic solution and hemicellulose. The washing liquids and the spent caustic solution containing hemicellulose are combined and concentrated to form a concentrated CCE filtrate. The concentrated CCE filtrate may then be used singularly or in combination with another caustic solution to treat wood in the reaction vessel.

All steps outlined above may be carried out with traditional equipment. Following the steps outlined above in accordance with the specification can result in a concentrated CCE filtrate having comparable effective alkali concentration to that of a white liquor commonly used for cooking.

Figure 1:
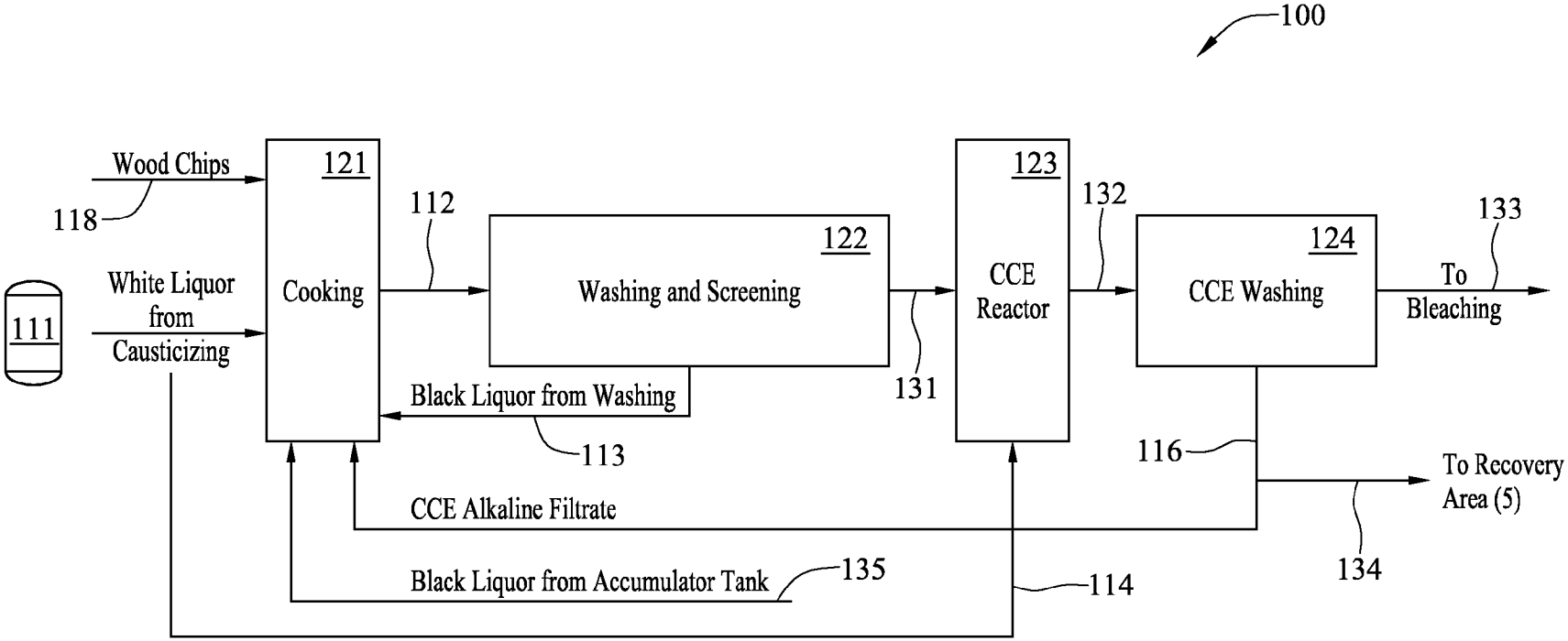
FIG. 1 is a general process flow diagram of a conventional pre-hydrolysis kraft pulp process used in connection with pulp production, as known in the art.
Figure 2:
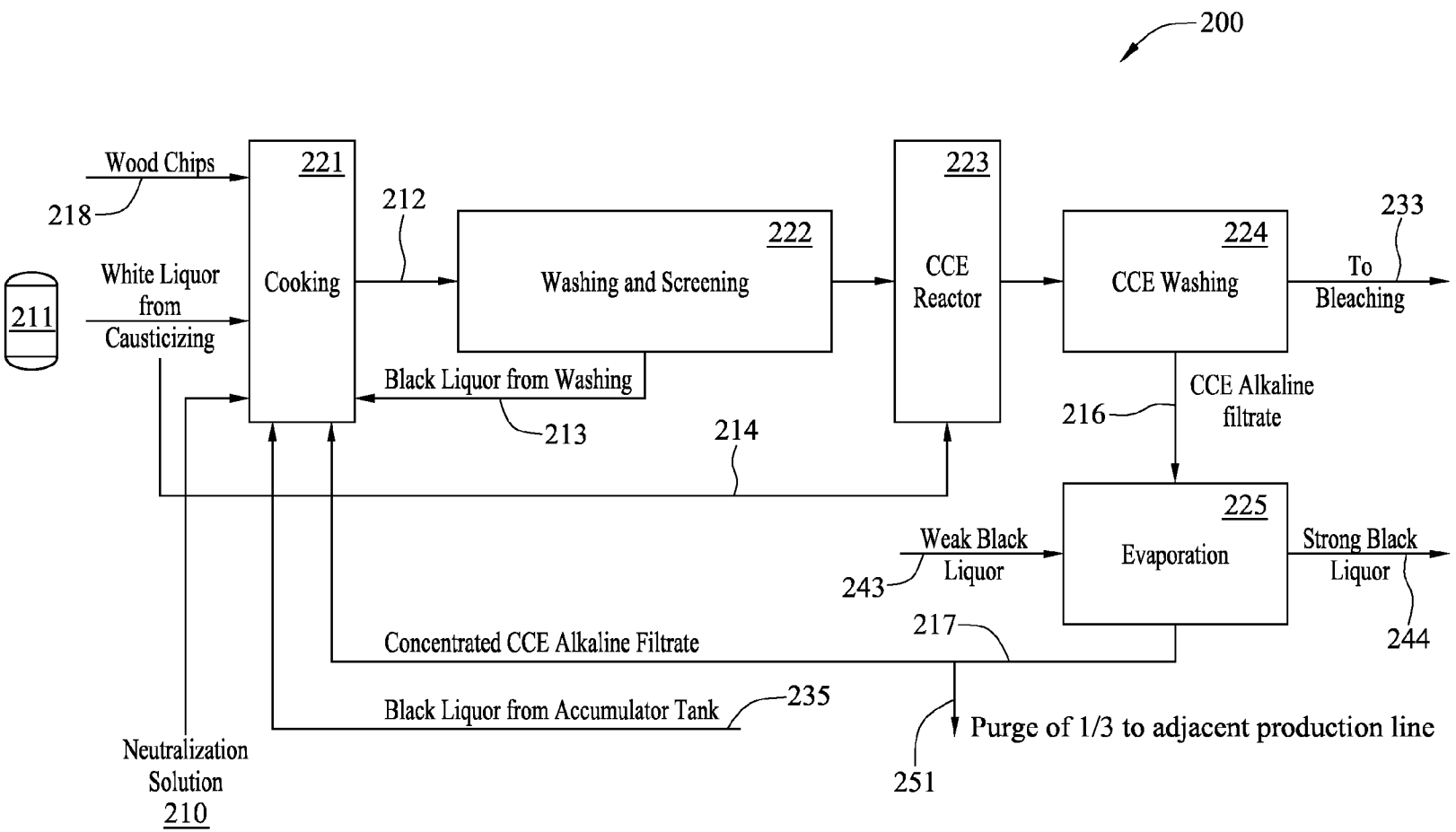
FIG. 2 is a process flow diagram of a pulp production process in accordance with one embodiment as disclosed herein.

A process according to one embodiment is illustrated in FIG. 2. The process 200 begins with a cooking stage 221 in which, similar to a conventional kraft process, wood chips or other pulp-containing organic materials 218 are fed into a digester capable of withstanding high pressure. The digester may be of any suitable volume such as, for example, approximately 360 cubic meters. In a typical industrial setting, a plurality of digesters may be run in parallel, with different digesters operating at different stages of the pulp production process.

The particular choice of wood type or other plant or organic materials used in the digesters may depend upon the desired end products. For example, soft woods such as pine, fir and spruce may be used for some derivatization processes to obtain products with high viscosity, like cellulose ethers (which may be used, for example, as additives in food, paint, oil recovery fluids or muds, paper, cosmetics, pharmaceuticals, adhesives, printing, agriculture, ceramics, textiles, detergents and building materials). Hardwoods, such as eucalyptus and acacia may be preferred for those applications that do not require a pulp with very high viscosity.

In one embodiment, the digester is heated during the cooking stage 221 to a first pre-determined temperature with steam or other appropriate means. This pre-determined temperature may be between 110 to 130° C. and more specifically, for example, may be 120° C. The heating in this particular example is effected over a period of time between 15 to 60 minutes (e.g., 30 minutes), although other heating times may be used depending upon the particulars of the equipment and the nature of the organic materials being heated.

The digester is preferably then further heated by steam or other means to a second temperature above the first pre-determined temperature for a pre-hydrolysis stage. This second pre-hydrolysis temperature is preferably around 165° C., although again the precise temperature may depend upon a number of variables including the equipment and organic materials. The heating for pre-hydrolysis may be effected over a period of 30 to 120 minutes (e.g., 60 minutes), although again the heating time may vary as needed. Once the pre-hydrolysis temperature is attained, the digester is held at that temperature for a suitable period of time, e.g., 35 to 45 minutes, or any other time sufficient to complete pre-hydrolysis.

In a preferred embodiment, a neutralization solution 210 is added to digester as part of the cooking stage 221. The neutralization solution 210 may be composed of a freshly prepared white liquor followed by black liquor, or it may be composed of a CCE filtrate followed by black liquor. A white liquor may take the form of, e.g., a mixture of sodium hydroxide and sodium sulfide. In a preferred embodiment, the white liquor has between 85 to 150 gram per liter effective alkali as sodium hydroxide (NaOH), more preferably between 95 to 125 gram per liter of effective alkali as sodium hydroxide, and most preferably between 100 to 110 gram per liter of effective alkali as sodium hydroxide. The sulfidity of the white liquor may have a range between 10% and 40%, preferably between 15 and 35%, and most preferably between 20 and 30%.

The concentration of effective NaOH in black liquor may be between 10 to 50 grams per liter, although it may vary according to the particular process. In one embodiment, the neutralization solution 210 comprises both a white liquor and a black liquor, with an effective alkali concentration of 85 to 150 grams sodium hydroxide per liter for the white liquor and an effective alkali concentration of 20 to 50 grams sodium hydroxide per liter for the black liquor. In a preferred embodiment, the neutralization solution 210 comprising both a white liquor and a black liquor has an effective alkali concentration, respectively of between 95 to 125 grams per liter and 30 to 35 grams per liter, and more preferably has an effective concentration of between 100 and 110 grams per liter and 38 to 45 grams per liter, respectively. The neutralization solution 210 may have an effective alkali concentration of 38 to 48 grams NaOH per liter for the combined liquors.

The neutralization solution 210 may be added to the digester in one portion or else may be added to the digester in several portions. In one embodiment, the neutralizing solution 210 comprising of both a white liquor and a black liquor is added in two portions, whereby the white liquor is first provided to the digester followed by addition of the black liquor. In one embodiment, the neutralization solution 210 is added at a temperature between 130 to 160° C., and more preferably between 140 to 150° C. The addition can be made over a period of 15 to 60 minutes, preferably over a period of 30 minutes. In a preferred embodiment, the neutralization solution 210 is added in two portions, each over a 15-minute period at a temperature between 140 to 150° C.

A first caustic solution 211 then may replace the neutralization solution 210 and is used for cooking the wood in the digester. The first caustic solution 211 may have the same composition as that of the neutralization solution 210, or may have a different composition. The range and preferred range of sodium hydroxide and sodium sulfide in the first caustic solution 211 are the same as those for the neutralization solution 210, and are well known to one skilled in the art.

The digester may be heated to the cooking temperature with steam or other means. The cooking temperature may be in the range between 140 and 180° C., and is preferably in the range between 145 to 160° C. The heating can be over a period of 10 to 30 minutes or other suitable period. The digester is held at the cooking temperature for a suitable period for the cooking process, such as between 15 to 120 minutes. The temperature range and the cooking time are chosen for target H factor, which is preferably in the range of between 130 and 250.

Preferred techniques for neutralization and cooking are described in copending U.S. patent application Ser. No. 12/789,307 filed concurrently herewith and entitled "Method and System for High Alpha Dissolving Pulp Production," assigned to the assignee of the present invention, and hereby incorporated by reference as if set forth fully herein.

As a result of the cooking stage 221, a brown stock 212 is produced. The brown stock 212 is provided to a washing and screening process 222, similar to a conventional kraft procedure, whereupon the brown stock 212 is screened through the use of different types of sieves or screens and centrifugal cleaning. The brown stock 212 is then washed with a washer in the screening and washing process 222. The washer may be of any commercial type, including horizontal belt washers, rotary drum washers, vacuum filters, wash presses, compaction baffle filters, atmospheric diffusers and pressure diffusers. The washing unit may use counter current flow between the stages so that pulp moves in the opposite direction to the washing waters. In one embodiment, pressurized water is used to wash the brown stock 212. In another embodiment, a diluted caustic solution is used to wash the brown stock 212. The diluted caustic solution may, for example, have an effective alkali concentration of less than 5 grams NaOH per liter, more preferably of less than 1 gram NaOH per liter. The spent washing liquor is collected and used as black liquor 213 elsewhere in the process 200. In one embodiment, the black liquor 213 is used as part of the cooking liquor or other caustic solution 211 provided to the digester in the cooking stage 221.

The semi-purified pulp from the washing and screening process 222 is then pumped as a slurry to a reactor which is employed in cold caustic extraction ("CCE") stage 223, again similar to the conventional method, in which the semi-purified pulp is mixed with a second caustic solution 214 (which may be the same or different from the first caustic solution 211) to effect further separation of hemicellulose from the desired cellulosic fibers. Cold caustic extraction is a process well known in the art. Examples of cold caustic treatment systems are described in greater detail, for instance, in Ali et al., U.S. Patent Application Publication No. 2004/0020854, and Svenson et al., U.S. Patent Application Publication No. 2005/0203291, both of which are hereby incorporated by reference as if set forth fully herein.

The hemicellulose extraction in the CCE extraction process 223 is conducted at a suitable temperature, typically between 15 and 50° C., and preferably around 30° C. The pH of the pulp slurry is typically above 13 with an effective alkali between 60 to 90 grams of NaOH per liter. The pulp is steeped in the cold caustic solution 214 for a sufficient amount of time to achieve the desired degree of diffusion of hemicellulose into the solution. An exemplary dwell time for an extraction at 30° C. at pH 13 is 30 minutes. Cold caustic extraction can generally result in purified pulp with alpha cellulose content in the range of 92 to 96 percent, although historically it has been quite difficult to reach purities at the upper end of that scale or beyond, particularly while maintaining other desirable characteristics of the pulp (such as viscosity level). It has also been difficult to reach high purities while maintaining high process efficiency.

The caustic solution 214 used in the blending and extraction procedures of the CCE extraction process 223 may comprise freshly prepared sodium hydroxide solutions, recovery from the downstream process, or by-products in a pulp or paper mill operation, e.g., hemi caustic white liquor, oxidized white liquor and the like. Other basic solutions, such as ammonium hydroxide and potassium hydroxide, may also be employed.

The caustic solution 214 used in the CCE extraction process 223 may contain a suitable hydroxide concentration; for example, the caustic solution 214 may contain 3% to 50% by weight hydroxide concentration, and more preferably between 6% to 18% by weight hydroxide concentration. The extraction may be performed at any suitable pulp consistency, such as from about 2% to 50% by weight, but preferably from about 5% to 10% by weight. In this context, the term "consistency" refers to the concentration of the cellulosic fibers in the extraction mixture.

After the desired dwell time, the pulp is separated from the spent cold caustic solution in a following washing process 224. The spent cold caustic solution contains extracted hemicellulose. The pulp is washed in CCE washing unit. Exemplary washers include horizontal belt washers, rotary drum washers, vacuum filters, wash presses, compaction baffle filters, atmospheric diffusers and pressure diffusers. The washing liquid may comprise, for example, pure water or diluted caustic solution with an effective alkali concentration of, e.g., below 1 gram NaOH per liter. The spent washing liquid is collected in a conventional manner and can be combined with spent cold caustic solution to form another caustic solution 216 which, in one aspect, comprises an alkaline filtrate resulting from the washing process 224. The extracted and washed pulp 233 is, in the meantime, transported to the next stage for bleaching.

The third caustic solution 216 is preferably provided to a concentrating process 225, and may, for example, be fed into an evaporation system for concentration. A typical evaporation system may contain several units or effects installed in series. The liquid moves through each effect and becomes more concentrated at the outlet of the effect. Vacuum may be applied to facilitate the evaporation and concentration of solutions.

In connection with the concentrating process 225, a weak black liquor 243 may be concentrated into a strong black liquor 244 by, e.g., evaporation using one or more effects in sequential arrangement, gradually increasing the concentration of the weak black liquor 243 during the process. The strong black liquor 244 may be stored in an accumulation tank and used in the recovery area (recovery boiler) or for other purposes, thus increasing efficiency through the reuse or recycling of output by-products.

The number of effects used for evaporation depends in part upon the desired concentration level, the capacity of the plant, and other factors. In one embodiment, the evaporation equipment for the concentrating stage 225 comprises six effects capable of processing, e.g., 740 tons of liquor per hour. The effects may, but need not, be of the same type used to concentrate black liquor from the cooking stage 221. It is typical, for example, to use a series of effects to concentrate the weak black liquor left over from the cooking stage and store it in a holding tank, where it can either be recycled for use in the cooking process or else sent to other processes for different purposes. Commonly, an excess of black liquor is produced, and the excess black liquor is burned in an incinerator for power generation.

In a preferred embodiment (as illustrated FIG. 3), concentration of the alkaline extract solution 316 from the CCE washing stage 224 takes place in two of six effects (in this example, the fifth effect 327 and sixth effect 328) under a reduced pressure to afford a concentrated solution 330, i.e., a concentrated CCE alkaline filtrate. Concentration of the weak black liquor from the cooking stage 221 into concentrated black liquor takes place in four of the six effects at a higher pressure. In this example, weak black liquor 313 is introduced into one effect (in this example, the fourth effect 326), and after preliminary concentration, is pumped for further concentration in other downstream effects 329. Concentration of the alkaline extract solution 316 from the CCE washing stage 224, which may be a combination of spent washing liquid 314 and spent cold caustic solution 315, may be provided in the fifth and sixth effects 327 and 328 at a suitable pressure and for a sufficient duration to arrive at the desired concentration, which in one example is between about 85 and 110 gram(s) NaOH per liter, and more preferably in the range between 95 and 105 gram(s) NaOH per liter. In one embodiment, the alkaline extract solution 316 remains in the fifth effect 327 under a negative pressure of approximately −0.84 bar(g), and in the sixth effect 328 under a negative pressure of approximately −0.50 bar(g), to afford a concentrated solution 330 having an effective alkali concentration of, e.g., between approximately 95 and 105 gram(s) NaOH per liter.

Advantageously, a processing plant can be configured to employ the inventive process with no significant additional outlay of equipment required. Where a plant has been using, for example, six effects for concentrating weak black liquor left over from the cooking stage, two of the effects may be re-deployed for use in concentrating the alkaline filtrate produced in the CCE washing process. The reduced number of effects available for black liquor concentration is not significant because while the capacity for black liquor evaporation is decreased by roughly 20 to 30%, the black liquor quality (final solids concentration) may be maintained, allowing the resulting black liquor from four effects to be burned in the recovery boiler without any significant impact. However, the use of two of the effects for alkaline filtrate concentration and recycling, according to the inventive techniques described herein, can have a meaningful impact on plant efficiency. Because the same number of effects can be used for two different processes, a plant may be configured so that the operator may select between using a conventional process for evaporation of weak black liquor in all of the effects, or else may allocate some of the effects for alkaline filtrate concentration without appreciable negative consequences, yet provide improvements in terms of efficiency.

Returning to FIG. 2, the concentrated alkaline filtrate solution 217 may be reused, in whole or part, as either a neutralization solution 210 and/or as part of the cooking liquor 211. In one embodiment, the neutralization solution 210 consists entirely of the concentrated alkaline filtrate solution 217. In another embodiment, the neutralization solution 210 comprises both the concentrated alkaline filtrate solution 217 and a white liquor, which may be added to the digester first and also optionally used to enrich the concentrated alkaline filtrate solution 217. In a third embodiment, the concentrated alkaline filtrate solution 217 is used as the cooking liquor 211. In a fourth embodiment, the concentrated alkaline filtrate solution 117 is combined with a white liquor for use as the cooking liquor 211.

Concentrated alkaline filtrate solution 217 that is not reused in the cooking stage 221 may be used for other purposes. For example, it may optionally be diverted for other purposes, such as for use on an adjacent production line (as white liquor), such as illustrated by arrow 251 in the example of FIG. 2. At the same time, the concentrated alkaline filtrate solution 217 may also allow the use of higher liquor concentrations in the cooking stage 221, thus preventing re-deposition of hemicelluloses on the fibers.

Figure 4:
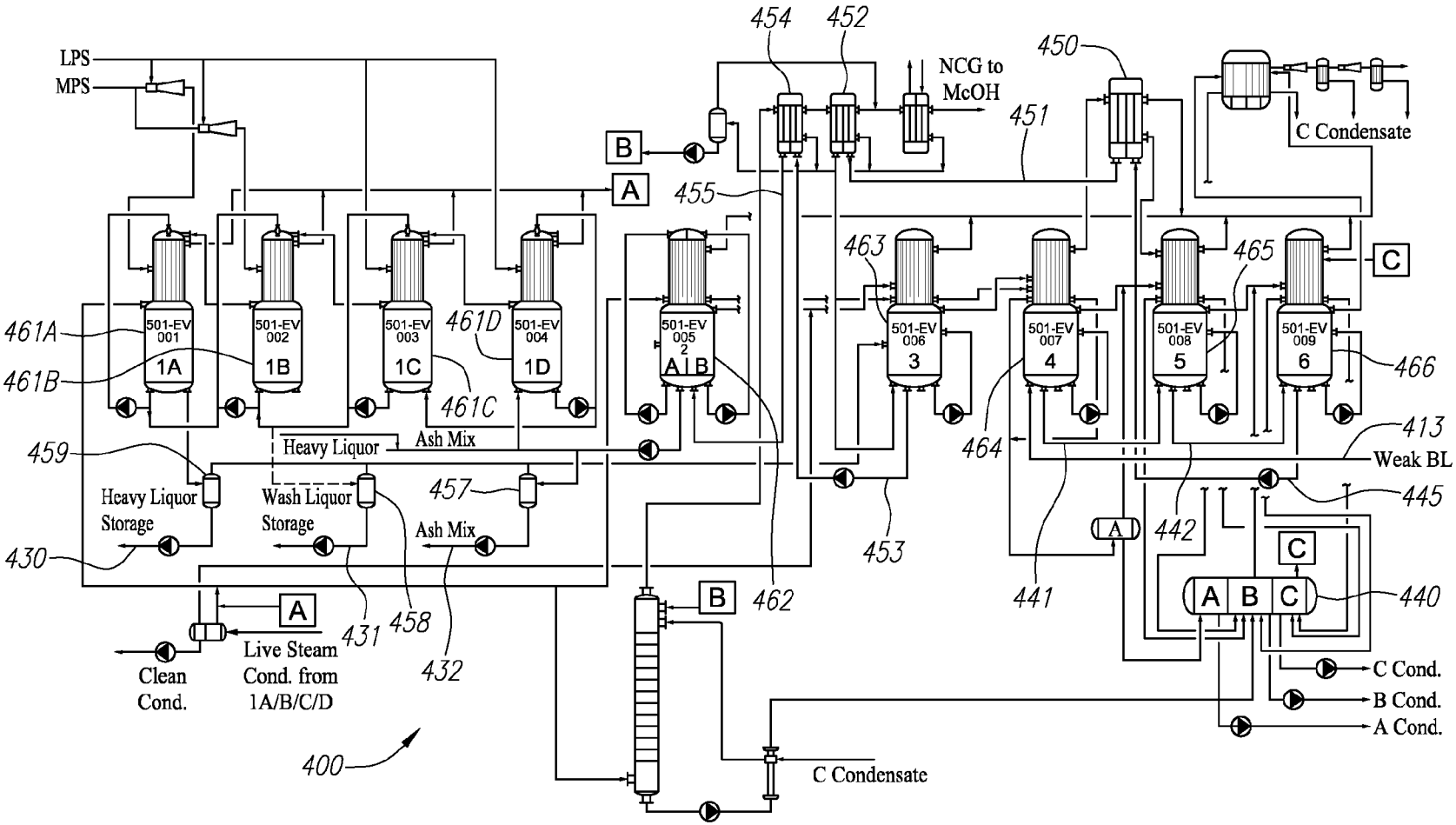
FIG. 4 is a diagram of a conventional system and process of evaporation as may be used in connection with, among other things, cold caustic extraction.
Figure 5:
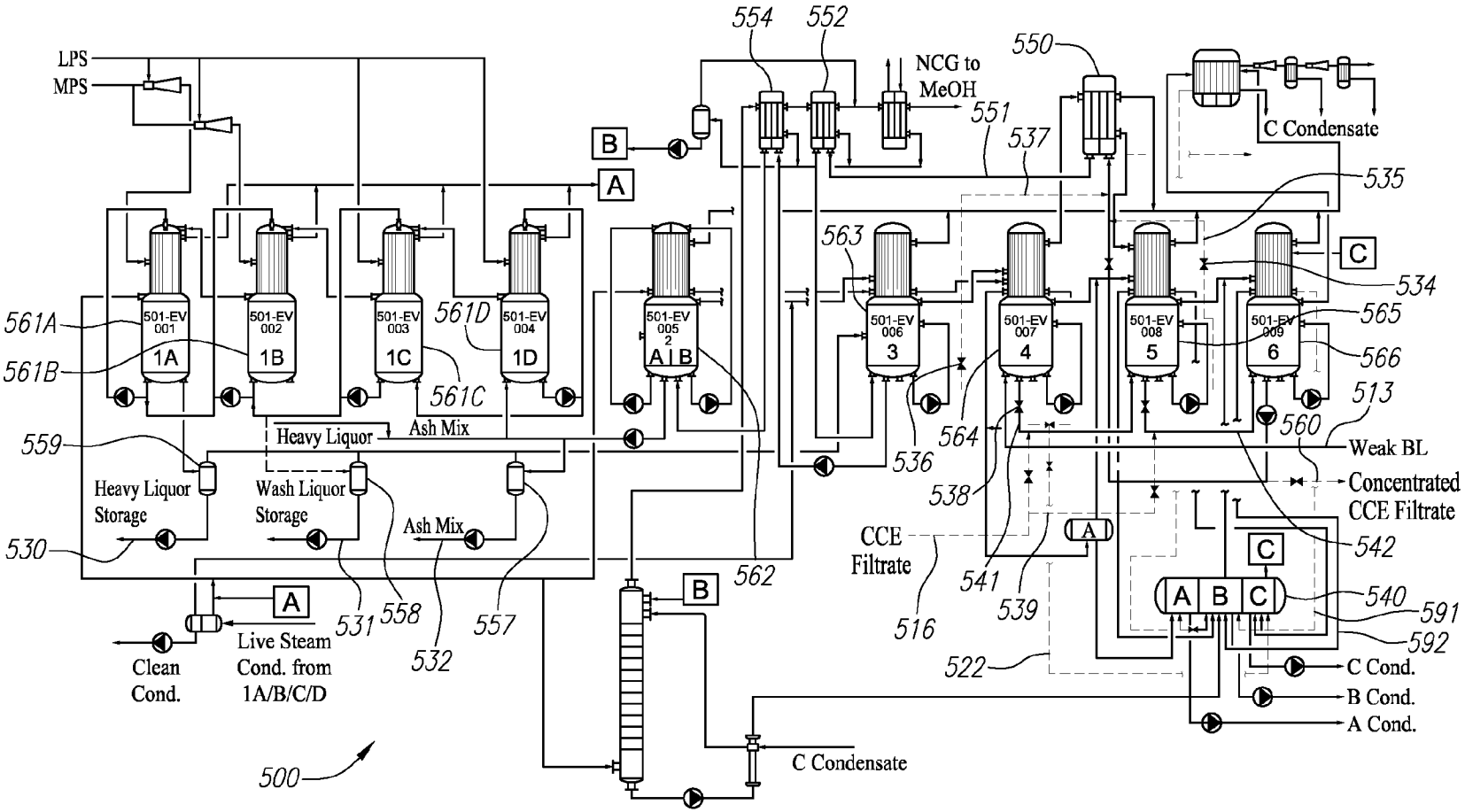
FIG. 5 is a diagram of a system and related process for filtrate evaporation from cold caustic extraction in accordance with the general principles illustrated in FIGS. 2 and 3.

FIGS. 4 and 5 illustrate and compare a conventional system for an evaporation process in connection a cold caustic extraction, with one possible embodiment as disclosed herein. FIG. 4 is a diagram of a conventional system 400 reflecting a process of evaporation as may be used with, among other things, cold caustic extraction. As shown in FIG. 4, the system 400 includes a number of effects 461A-D and 462-466. A weak black liquor 413 from a cooking process is received into one of the effects, in this case the fourth effect 464, where the evaporation process begins. Pipes 441 and 442 respectively connect the fourth effect 464 to the fifth effect 465 and the fifth effect 465 to the sixth effect 466. After processing in the sixth effect 466, the semi-concentrated black liquor is moved into intermediary heat exchangers 450 and 452. From heat exchanger 452, the semi-concentrated black liquor is provided to the third effect 463, the product of which is moved into another intermediary heat exchanger 454.

From heat exchanger 454, the semi-concentrated black liquor is then provided to the second effect 462 (one body divided in two liquor circulation units "A" and "B"). After evaporation in the second effect 462, one part of the black liquor is pumped directly to the first effect (concentrator) and the other is subject to flash evaporation in evaporator 459 under atmospheric pressure and pumped 432 to ash mixing. The first effect may physically consist of four evaporators 461A-D. The evaporators may be falling film evaporators of tube and shell type. All four evaporators 461A-D may be in operation simultaneously, which can allow production of black liquor with higher concentrations. The liquor containing ash is pumped from the ash mixing tank to the evaporator 461D. After evaporation in the evaporator 461D, the concentrated heavy black liquor is flashed in flash evaporator 459 and stored in a pressurized heavy liquor tank (not shown in FIG. 4).

Among the outputs of the evaporation system 400 are a heavy (strong) black liquor 430, as well as a condensate 431 that is sent to wash liquor storage. The strong black liquor 430 may be used for purposes as previously described herein. In the condensate tank 440A, the vapor condensate from second, third and fourth effects 462, 463 and 464 is combined to form a clean condensate ("A-condensate") and may be flashed in several stages till it is subject to similar pressure to that of vapor inlet pressure of the sixth effect 466. The A-condensate is collected in the clean condensate tank (Tank A of condensate tank 440) and may be used elsewhere, e.g., in a fiber line.

Condensate from the clean side of the fourth and fifth effects 464 and 465 form an intermediate condensate ("B-condensate") which is flashed down or reduced in pressure in stages till it has a similar pressure to that of inlet pressure of the sixth effect 466. The flashed B-condensate is combined with treated or untreated condensates from other parts of the evaporation system, such as from the clean side of the sixth effect 466, the primary section of the segregated surface condenser 470, and/or the treated condensate from the stripping column. This combined condensate generally may contain more impurities than the A-condensate. The B-condensate is collected in the intermediate condensate tank (Tank B of condensate tank 440), and may be used in other parts of the pulp manufacturing production such as the causticizing plant.

Foul condensate ("C-condensate"), which generally contains more impurities than the A-condensate or B-condensate, may be collected from the foul side of the fifth and sixth effects 465 and 466, the secondary section of the segregated surface condenser, and the vacuum system. The C-condensate is stored in foul condensate tank (Tank C of condensate tank 440).

Figure 3:
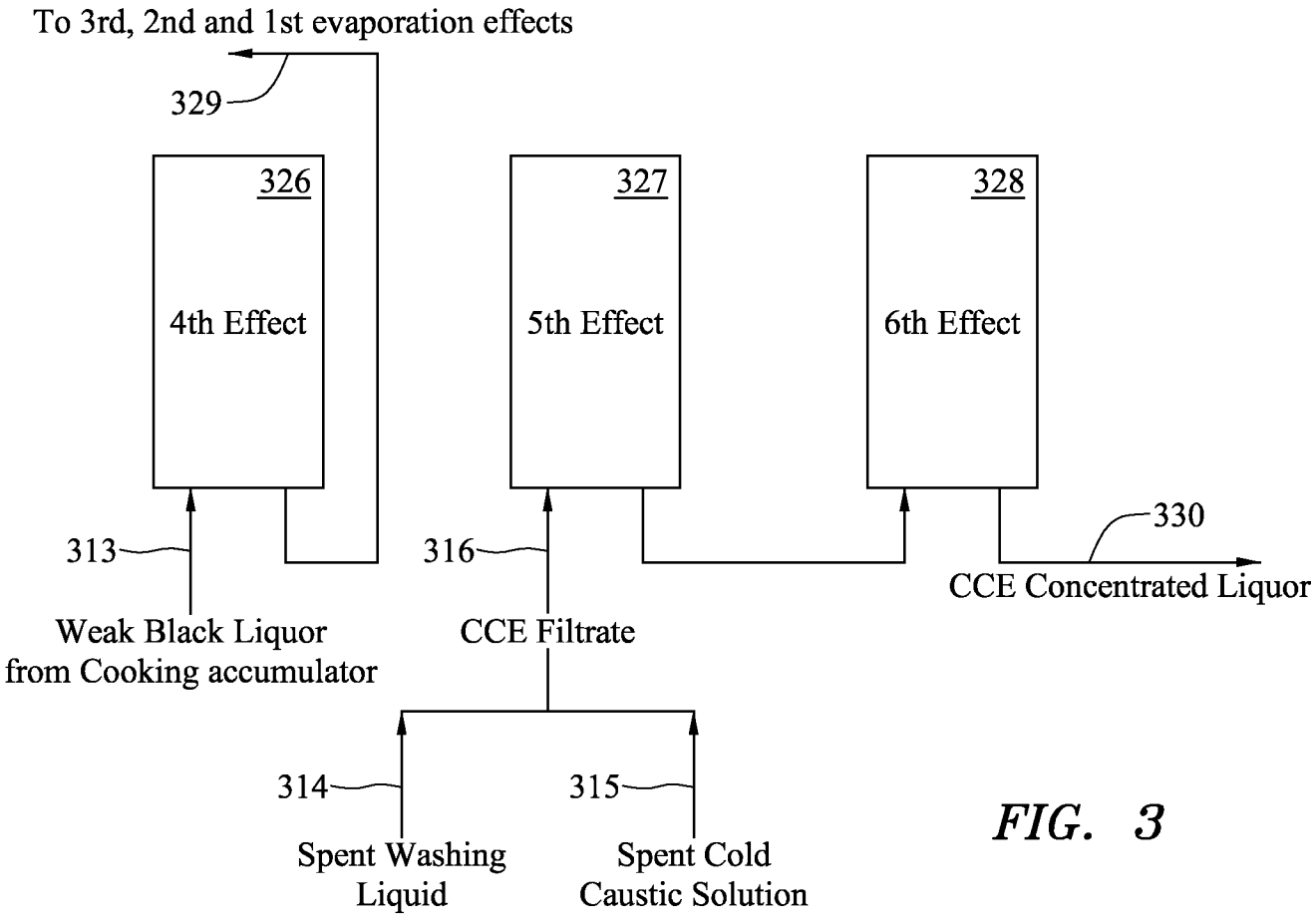
FIG. 3 is a conceptual diagram of a system and related process for evaporation post cold caustic extraction in accordance with the general principles illustrated in FIG. 2.

FIG. 5 is a diagram of a system 500 reflecting a process for filtrate evaporation from cold caustic extraction in accordance with the general principles illustrated in FIGS. 2 and 3. In this example, the system 500 uses the same basic equipment configuration and same number of effects as the system 400 of FIG. 4, although this need not be the case in other embodiments. The dotted lines in FIG. 5 show additional connections (including pipes and valves) that may be added to the equipment of FIG. 4 in order to arrive at the additional functionality of CCE filtrate concentrating. In FIG. 5, the system 500 again has multiple effects 561A-D and 562-566. Effects 561A-561D, 562 and 563 serve the same general purpose as the corresponding effects 461A-D, 462 and 463 in FIG. 4. However, in the system 500 shown in FIG. 5, after the weak black liquor 513 is initially concentrated in the fourth effect 564, it is provided via a bypass pipe 537 (as controlled by added valve 536) to the heat exchanger 550 (which otherwise is similar to heat exchanger 450 of FIG. 4). This way, the weak black liquor concentrating process bypasses the fifth and sixth effects 565, 566.

Unlike the system 400 of FIG. 4, in the system 500 of FIG. 5 a cold caustic extraction (CCE) filtrate 516 from the CCE washing step is provided via connector pipe 541 to the fifth effect 565, whereupon it undergoes the first part of the concentrating process. A new valve 538 has been added over FIG. 4 to allow isolation of the fourth effect 564 from the CCE filtrate 516. An optional branch connector pipe 539 may be added to link the CCE filtrate 516 to the sixth effect 566, to allow the option of provided CCE filtrate directly to the sixth effect 566 if, for example, a lesser amount of concentration is desired. Otherwise, after evaporation in the fifth effect 565, the semi-concentrated CCE filtrate is provided to the sixth effect 566 via a connector pipe 542, whereupon it undergoes further concentration via evaporation to the desired extent.

The concentrated CCE filtrate 560 may be directed via line 591 to Tank C in condensate tank 540, or via line 592 to Tank B of condensate tank 540. In connection with the kraft processing steps described previously, the concentrated CCE filtrate 560 may be mixed with white liquor, black liquor or other solutions as part of the cooking stage. If desired, the semi-concentrated CCE filtrate may be sent to heat exchanger 550 from the fifth effect 565 via another added connector pipe 535, as controlled by valve 534. Connector pipe 535 also provides the option of using five effects for weak black liquor concentration and only a single effect (the sixth effect) for CCE filtrate concentration. This configuration provides, among other things, significant flexibility in terms of various mixes and concentrations of cooking and washing solutions. In this embodiment where CCE filtrate is concentrated in fifth and sixth effects 565 and 566, condensate flows can be changed through switches of valves: for example, foul side of the fourth effect 564 can be part of the foul condensate (C-condensate); condensate from foul side of the sixth effect 466 can be part of intermediate condensate (B-condensate); and condensate from the primary section of the segregated surface condenser can be part of the clean condensate (A-condensate).

EXAMPLES

The processes of embodiments of the present invention are demonstrated in the following examples. Analytical results described in the examples are obtained using the following methods.

The method used to measure S10 and S18 solubility of pulp at 25° C. is based on the TAPPI Standard T 235 cm-00, hereby incorporated by reference as if set forth fully herein. Pulp is extracted with a sodium hydroxide (NaOH) solution of 10% and 18%, respectively. The dissolved carbohydrates are determined by oxidation with potassium dichromate. Low molecular weight carbohydrates such as hemicelluloses and degraded cellulose can be extracted from pulps with sodium hydroxide solutions. Solubility of a pulp in alkali thus provides information on the degradation of cellulose and on a loss or retention of hemicelluloses during pulping and bleaching process. In a typical procedure for S10 solubility measurement, a 10 gram of oven dried pulp sample is placed in a beaker and 75 mL of 10 w.t. % NaOH solution is added to the pulp. The mixture is stirred with a dispersion apparatus for sufficient time until the pulp is completely dispersed. One example of a dispersion apparatus may contain a variable speed motor and a stainless steel stirrer with a shell. The speed of the motor and the angle of the blades are adjusted so that no air is drawn into the pulp suspension during stirring. After the pulp is completely dispersed, another 25 mL of 10% NaOH is added to the mixture to ensure that all pulp fibers are covered by the alkali solution. The beaker containing the mixture is kept in a water bath at 25±0.2° C. for 60 min from the time of the first addition of the NaOH regent. After this time, about 50 ml of the filtrate is collected in a clean and dry filtration flask. An aliquot of 10.0 mL of the filtrate is mixed with 10.0 mL of a 0.5N potassium dichromate solution in a 250 mL flask. To this, 30 mL of concentrated sulfuric acid is added with stirring, during which time the solution gets hot from chemical reactions. The solution is stirred for 15 minutes while kept hot. 50 mL of water is then added to the mixture and the mixture is cooled to room temperature. Two to four drops of ferroin indicator is added to the mixture, and the mixture is titrated with a 0.1N ferrous ammonium sulfate solution. The titration is repeated using 10 mL of the 10% NaOH solution. S10 Solubility is calculated using the following formula:

$$S,\%=[(V_2-V_1)*N*6.85*10]/(A*W)$$

where, $V_1$ is the volume of ferrous ammonium sulfate solution used to titrate the filtrate, and the unit is milliliter; $V_2$, also in milliliter is the volume of ammonium sulfate solution used to titrate a pure 10% NaOH solution, N is the normality of the ferrous ammonium sulfate solution; A, with a unit in milliliter, is the volume of the pulp filtrate used in the oxidation; and W is the oven-dried weight of pulp sample in grams.

The procedure is the same for S18 solubility determination, except that an 18% NaOH solution replaces the 10% NaOH solution used above.

Pulp viscosity in cupriethylenediamine (CED) solution is determined using a method based on the SCAN Standard CM 15-99, hereby incorporated by reference as if set forth fully herein. The method determinates the intrinsic viscosity number of pulp in dilute CED solution. In a typical procedure, a sample of pulp is dissolved in CED solution. The amount of pulp is chosen with regard to the expected intrinsic viscosity number. The weighed pulp sample is placed in a polyethylene bottle (approx. 52 mL in volume) wherein residual air is expelled by squeezing the bottle. 5 to 10 pieces of copper wire and 25 mL of deionized water are added to the pulp, and the mixture is shaken with an appropriate shaking device until the pulp is completely disintegrated. The typical time interval for the disintegration is between 10 to 30 minutes. Another 25.0 mL of CED solution is added to the mixture. After the residual air is expelled, the bottle is closed tightly and shaken again for approximately 30 minutes or until the pulp sample is completely dissolved. The temperature of the test solution and the viscometer are adjusted to 25° C. A portion of the test solution is drawn into the test viscometer by suction. The efflux time, that is, the time it takes for the meniscus to fall from the upper to the lower mark of the viscometer, is measured. The relative viscosity is calculated using the equation:

$$(\eta_{rel}) = \frac{F}{Tced} \times T$$

where, F is a calibration factor of the viscometers; $T_{ced}$, in seconds, is the efflux time for a 50% CED solution; T is the efflux time for the test solution, also in seconds. The equivalent (η*c) value may be found in the table attached to the SCAN standard, where η is the intrinsic viscosity of the pulp with a unit of mL/g, and c is the concentration of test solution calculated as the dry weight of pulp divided by the volume of the test solution, which is 50 ML in this example.

The Kappa number (KN) is measured is using a method similar to that of TAPPI Standard T 236 om-99. KN corresponds to the volume (in mL) of 0.1N potassium permanganate solution used to oxidize one gram of oven-dried pulp. In a typical procedure, a pulp sample is disintegrated or dissolved in approximately 300 ml of distilled water. The disintegrated or dissolved pulp specimen is transferred to a beaker and sufficient water is added to the pulp mixture bring the total volume of the mixture to about 795 mL. 100 mL of a 0.1N potassium permanganate solution and 100 mL of a 4N sulfuric acid 4N is mixed in a separate beaker, and the mixture is adjusted to 25° C. quickly. The acidified potassium permanganate solution is added immediately to the test pulp. After the addition, the total volume of the mixture is approximately 1000±5 mL. The mixture is allowed to react for ten minutes, after which period, 20 mL of a 1N potassium iodide solution is added to quench the reaction. The free iodine content of the mixture is determined immediately afterwards by titrating the pulp mixture with a 0.2N solution of sodium thiosulfate. The end point of the titration is indicated by starch indicator added toward the end of reaction. The titration is carried out without removing pulp fibers. Another titration is carried out with a blank solution without pulp. KN is calculated using the following formula:

$$KN=(p*f)/w$$

where p is the amount of 0.1N potassium permanganate in milliliter consumed by the test specimen; f is a factor for correction to a 50% permanganate volume and dependent of "p," which may be found in the Tappi standard; w is the oven-dried weight of the pulp sample; and "p" is determined as follows:

$$p=[(b-a)*NJ/0.1$$

where, b is the amount of the thiosulfate in milliliter consumed in titrating the blank solution; a is the amount of thiosulfate consumed in titrating the pulp sample; and N is the normality of the thiosulfate.

Example 1

Concentration of CCE Filtrate

According to a first example, a stream of very diluted caustic solution at an effective alkali concentration of 5.6 grams NaOH per liter is introduced into the fifth effect 327 as shown in FIG. 3 to start the plant running and to observe its behavior with different alkali concentration levels. Water is removed from the solution at a reduced pressure of −0.73 bar at a temperature between 51.5° C. and 56.8° C. After 4 hours and 30 minutes, a caustic solution with an effective alkali concentration of about 50 gram NaOH per liter, similar to the raw CCE filtrate, is fed in the fifth effect getting at the outlet of the sixth effect from an inlet filtrate concentration about 50 grams NaOH per liter. Table I lists the flow rate, temperature, effective alkali concentration and vacuum level as a function of time.

TABLE I

| | Feeding | | Effective alkali (g NaOH/l) | | |
|---|---|---|---|---|---|
| Time (min.) | Flow ($m^3$/h) | Temperature (° C.) | Input at Effect 5 | Output at Effect 6 | Pressure (bar) |
| 0 | 350 | 51.5 | 5.6 | | −0.73 |
| 65 | 370 | 54.7 | | 14.1 | −0.73 |
| 105 | 370 | 56.8 | | 36.6 | −0.73 |
| 210 | 370 | 55.9 | 27.4 | 58.1 | −0.73 |
| 270 | 400 | 53.6 | 49.8 | 106.9 | −0.73 |
| 290 | 450 | 54.1 | 69.6 | 104.9 | −0.73 |

Example 2

Conventional Kraft Process

According to a second example, an experimental kraft process is carried out in a bench scale digester (approximately 20 liters volume) to simulate the industrial processing. A 20-liter bench scale digester is pre-heated with steam to 120° C. over a period of 30 minutes. A suitable quantity (such as 4.7 kg oven dry basis) of eucalyptus wood chip is added to the digester. The digester is heated to 165° C. over a period of 60 minutes and held at 165° C. for a further 40 minutes to complete the pre-hydrolysis stage. For a conventional kraft process (not using filtrates from the CCE), 4.51 liters of a first white liquor ("WL1") with an effective alkali concentration of 124.7 g NaOH per liter is added to the digester over fifteen minutes at a temperature of 152° C. The typical alkali charge for the neutralization is about 12% of Effective Alkali (EA) as NaOH on the dry chips weight. The digester is then filled with 10.8 liters of hot black liquor with an effective alkali concentration of 25.3 g NaOH per liter ("HBL1") added over 15 minutes at a temperature of 140° C. to complete the neutralization step. Ten liters of a second hot black liquor ("HBL2") of the same concentration is added to the digester to displace the neutralized liquor over a period of 23 minutes at a temperature of 146° C., followed by the cooking liquor consisting of a mixture of 1.0 liters of hot black liquor ("HBL2") and 4.16 liters of a second white liquor ("WL2") with an effective alkali concentration of 124.7 g NaOH per liter over a period of 12 minutes at 10 bar and 152° C. The typical alkali charge for the cooking phase is about 11% of Effective Alkali (EA) as NaOH on the dry chips weight. The cooking liquor is circulated at a rate of 3 liters per minute for 3 minutes under a pressure of 9.1 bar. The digester is then heated to 160° C. over a period of 14 minutes, and held at 160° C. for another 23 minutes. The digester is then cooled, and the reaction mixture is washed twice with a diluted caustic solution. Each wash uses 15-liter of an aqueous solution containing approximately 0.2 g NaOH per liter of solution. The resulting brown stock shows a Kappa Number of 10.3, a viscosity of 988 ml/g, an S10 solubility of 3.6% and an S18 solubility of 2.7%. The reaction has a 39.3% yield. When screened, the mixture has 0.13% rejects, resulting in a screening yield of 39.1%.

Example 3

Use of Weak Concentration CCE Filtrate as Neutralization Solution and Cooking Solution According to a third example, the same pulping process as described in Example 2 is repeated, except that the white liquor for the neutralization and cooking stages is replaced with a filtrate from the CCE step having an EA of 54 g NaOH per liter ("CCE54"). The Neutralysate has a pH of 11.0, and the cooking mixture has an EoC of 18.5 g NaOH per liter. The P factor for the pre-hydrolysis is 297 and the H factor for the cooking reaction is 419. For this example the total equivalent effective alkali charge on the wood are respectively: 12% EA as NaOH for the Neutralization phase and 11% EA as NaOH for the Cooking phase.

The resulting brown stock shows a Kappa Number of 10.8, a viscosity of 1118 ml/g, an S10 solubility of 4.5% and an S18 solubility of 3.6%. The reaction has a 40.4% yield. When screened, the mixture has a 0.09% rejection rate, resulting in a screening yield of 40.3%.

Example 4

Use of Highly Concentrated CCE Filtrate as Neutralization Solution and Cooking Solution According to a fourth example, the same pulping process as described in Example 2 is repeated, except that two thirds of WL1 and WL2 is replaced with concentrated CCE filtrate an effective alkali concentration of 110 g NaOH per liter. The resulting brown stock shows a Kappa Number of 9.5, a viscosity of 990 ml/g, an S10 solubility of 4.1% and an S18 solubility of 3.0%. The reaction has a 39.5% yield. When screened, the mixture has 0.10% rejects, resulting in a screening yield of 39.43%.

Compared to the conventional kraft process, the process where two thirds of the white liquor is replaced by concentrated CCE filtrate produces pulps of similar viscosities (about 990 mg/l in this example) and Kappa numbers to those in the traditional kraft process. It is expected that a similar technique would work over a broader range; for example, where between 60% to 75% of the white liquor is replaced by concentrated CCE filtrate. The slightly lower Kappa number achieved with concentrated CCE filtrate suggests that replacing white liquors with concentrated CCE filtrate does not negatively impact delignification. The viscosity to Kappa Number ratio—a measure of selectivity in the cooking step—is higher for the process with concentrated CCE filtrate (104 versus 96 in the traditional process), indicating better cooking selectivity using concentrated CCE filtrate.

The S18 solubility increases from 2.7% to 3.0% and the S10 solubility increases from 3.6% to about 4.1% when concentrated CCE filtrate replaces part of white liquors, indicating that some hemicelluloses re-deposition occurs. The S18 solubility level may be further controlled by other means if desired.

It should be possible to optimize the process further by lowering the cooking temperature slightly to achieve the same Kappa number (around 10.8) and a higher viscosity. Based on the various experiments, it is expected that minor variations to the process including alkaline levels, relative quantities of white liquor and concentrated CCE filtrate, cooking temperatures and cooking times may be made, as would be determinable from routine calculations or optimizations based on the principles and techniques described herein, while still keeping the resulting brown stock qualities in a potentially desirable range. For example, it is expected that the resulting brown stock may yield a Kappa Number of under 10.0, a viscosity of under 1000 ml/g, an S18 solubility of no more than 3.0%, and/or a viscosity to Kappa number ratio of over 100.

According to certain embodiments disclosed herein, it is possible to cook for the same or similar viscosity and Kappa Number levels using concentrated CCE filtrate as a traditional kraft process that uses only fresh white liquor, thus leading to increased efficiency.

While preferred embodiments of the invention have been described herein, many variations are possible which remain within the concept and scope of the invention. Such variations would become clear to one of ordinary skill in the art after inspection of the specification and the drawings. The invention therefore is not to be restricted except within the spirit and scope of any appended claims.

What is claimed is:

1. A method for pulp manufacturing using cold caustic extraction for production of dissolving pulp, comprising:

delignifying organic materials in a digester and treating a resulting brown stock to yield semi-purified pulp for use in the production of dissolving pulp;

extracting the semi-purified pulp with a caustic solution during a cold caustic extraction process to yield a purified pulp and a solution containing hemicellulose;

washing the purified pulp and collecting a spent washing liquid therefrom while separating the hemicellulose-containing solution from the purified pulp;

combining the spent washing liquid and the hemicellulose-containing solution to form an alkaline filtrate;

concentrating the alkaline filtrate to form a concentrated alkaline filtrate without purifying the hemicellulose-containing solution or alkaline filtrate to substantially remove the hemicellulose therein; and utilizing at least a portion of the concentrated alkaline filtrate in said digester in connection with production of dissolving pulp.

2. The method of claim 1, wherein concentrating the alkaline filtrate is performed by an evaporation process.

3. The method of claim 2, wherein the evaporation process is carried out in a plurality of serially connected effects.

4. The method of claim 2, wherein said evaporation process is carried out at a temperature range of between about 50 and 60° C.

5. The method of claim 2, wherein the evaporation process is carried out at a pressure of −0.5 bar and −0.84 bar.

6. The method of claim 2, wherein the evaporation process is carried out until said concentrated alkaline filtrate has an effective alkali concentration of between about 95 and 125 grams NaOH per liter.

7. The method of claim 2, wherein the evaporation process is carried out until said concentrated alkaline filtrate has an effective alkali concentration of between about 100 and 110 grams NaOH per liter.

8. The method of claim 1, further comprising adding white liquor to the concentrated alkaline filtrate used in said digester.

9. The method of claim 8, wherein the ratio of white liquor to concentrated alkaline filtrate is between approximately 1:1.5 and 1:2.5.

10. The method of claim 1, wherein said caustic solution comprises NaOH and $Na_2S$.

11. A method for pulp manufacturing using cold caustic extraction in a kraft process, comprising:

cooking a first batch of organic materials in a digester to produce a brown stock;

washing and screening the brown stock to yield semi-purified pulp;

extracting the semi-purified pulp using cold caustic extraction to yield a purified pulp and a solution containing hemicellulose;

washing the purified pulp and collecting a spent washing liquid therefrom while separating the hemicellulose-containing solution from the purified pulp produced from cold caustic extraction;

combining the spent washing liquid and the hemicellulose-containing solution to form an alkaline filtrate;

evaporating the alkaline filtrate in a controlled environment to form a concentrated caustic solution without purifying the hemicellulose-containing solution or alkaline filtrate to substantially remove the hemicellulose therein; and using at least a portion of the concentrated caustic solution as at least one cooking fluid to cook a second batch of organic materials in connection with production of dissolving pulp.

12. The method of claim 11, further comprising using a second portion of the concentrated alkaline filtrate on a different pulp processing production line.

13. The method of claim 11, wherein the evaporation process is carried out in a plurality of serially connected effects.

14. The method of claim 11, wherein said evaporation process is carried out at a temperature range of between about 50 and 60° C.

15. The method of claim 11, wherein the evaporation process is carried out at a pressure of −0.5 bar and −0.84 bar.

16. The method of claim 11, wherein the evaporation process is carried out until said concentrated alkaline filtrate has an effective alkali concentration of between about 95 and 125 grams NaOH per liter.

17. The method of claim 11, wherein the evaporation process is carried out until said concentrated alkaline filtrate has an effective alkali concentration of between about 100 and 110 grams NaOH per liter.

18. The method of claim 11, further comprising adding white liquor to the concentrated alkaline filtrate used in said digester.

19. The method of claim 18, wherein the ratio of white liquor to concentrated alkaline filtrate is between approximately 1:1.5 and 1:2.5.

20. The method of claim 11, wherein a caustic solution used for cold caustic extraction comprises NaOH and $Na_2S$.

21. The method of claim 11, further comprising the steps of:

producing a second brown stock from cooking a second batch of organic materials in the digester;

washing and screening the second brown stock to yield semi-purified pulp; and using cold caustic extraction, extracting the semi-purified pulp derived from the second brown stock to yield a second purified pulp and a second solution containing hemicellulose.

22. The method of claim 21, wherein the second brown stock has an S18 solubility of no more than 3.0% prior to cold caustic extraction.

23. The method of claim 22, wherein the second brown stock has a Kappa number of less than 10.0 prior to cold caustic extraction.

24. The method of claim 22, wherein the second brown stock has a viscosity of approximately 1000 milliliters per gram prior to cold caustic extraction.

25. The method of claim 22, wherein the second brown stock shows a viscosity to Kappa Number ratio of 100 or higher prior to cold caustic extraction.

26. An improved method for pulp manufacturing using cold caustic extraction in a kraft process for producing dissolving pulp involving cooking organic materials in a digester to produce a brown stock, washing and screening the brown stock to yield pulp, and extracting the raw pulp using cold caustic extraction to yield a purified pulp and a solution containing hemicellulose, the improvement comprising:

washing the purified pulp and collecting a spent washing liquid therefrom while separating the hemicellulose-containing solution from the purified pulp produced from cold caustic extraction;

combining the spent washing liquid and the hemicellulose-containing solution to form an alkaline filtrate;

concentrating the caustic solution to form a concentrated alkaline filtrate without purifying the hemicellulose-containing solution or alkaline filtrate to substantially remove the hemicellulose therein; and utilizing at least a portion of the concentrated alkaline filtrate in the digester for neutralizing or cooking additional organic materials in connection with production of dissolving pulp.

27. A method for pulp manufacturing using cold caustic extraction in a kraft process for making dissolving pulp, comprising:

cooking organic materials in a plurality of batch digesters using at least a portion of concentrated caustic solution derived from a downstream cold caustic extraction stage, and thereby producing a brown stock;

washing and screening the brown stock to yield semi-purified pulp;

extracting the semi-purified pulp using cold caustic extraction to yield a purified pulp and a solution containing hemicellulose;

washing the purified pulp and collecting a spent washing liquid therefrom while separating the hemicellulose-containing solution from the purified pulp produced from cold caustic extraction;

combining the spent washing liquid and the hemicellulose-containing solution to form an alkaline filtrate;

evaporating the alkaline filtrate in a controlled environment to form a concentrated caustic solution without purifying the hemicellulose-containing solution or alkaline filtrate to substantially remove the hemicellulose therein; and returning at least a portion of the concentrated caustic solution to at least one of the batch digesters as at least one cooking fluid in connection with production of dissolving pulp.

28. The method of claim 3, wherein the evaporation process is carried out at a pressure of approximately −0.84 bar in a first effect, and at a pressure of approximately −0.5 bar in a second effect downstream from said first effect.

29. The method of claim 13, wherein the evaporation process is carried out at a pressure of approximately −0.84 bar in a first effect, and at a pressure of approximately −0.5 bar in a second effect downstream from said first effect.

30. A method for pulp manufacturing in a kraft process for making dissolving pulp, comprising:

neutralizing a first batch of organic materials using a neutralization fluid including a portion of white liquor followed by a second liquor different therefrom;

cooking the first batch of organic materials in a digester to produce a brown stock;

washing and screening the brown stock to yield semi-purified pulp;

extracting the semi-purified pulp using cold caustic extraction to yield a purified pulp and a solution containing hemicellulose;

washing the purified pulp and collecting a spent washing liquid therefrom while separating the hemicellulose-containing solution from the purified pulp produced from cold caustic extraction;

combining the spent washing liquid and the hemicellulose-containing solution to form an alkaline filtrate without substantially removing the hemicellulose components thereof;

evaporating the alkaline filtrate in a controlled environment to form a concentrated caustic solution without purifying the hemicellulose-containing solution or alkaline filtrate to substantially remove the hemicellulose therein; and using at least a portion of the concentrated caustic solution as at least one neutralization or cooking fluid to process a second batch of organic materials in connection with production of dissolving pulp.

31. The method of claim 30, wherein the a neutralization fluid for the second batch of organic materials includes a second portion of white liquor followed by the concentrated caustic solution.

32. The method of claim 30, wherein the evaporation process is carried out in a plurality of serially connected effects.

33. The method of claim 32, wherein said evaporation process is carried out at a temperature range of between about 50 and 60° C.

34. The method of claim 33, wherein the evaporation process is carried out at a pressure of approximately −0.84 bar in a first effect, and at a lower pressure in a second effect downstream from said first effect.

35. The method of claim 34, wherein the evaporation process is carried out until said concentrated alkaline filtrate has an effective alkali concentration of between about 100 and 110 grams NaOH per liter.

36. The method of claim 30, further comprising adding white liquor to the concentrated alkaline filtrate used to cook said second batch of organic materials.

37. The method of claim 36, wherein the concentrated alkaline filtrate forms 60% to 75% of the combination of concentrated alkaline filtrate and white liquor.

38. The method of claim 30, further comprising the steps of:

producing a second brown stock from cooking a second batch of organic materials in the digester;

washing and screening the second brown stock to yield semi-purified pulp; and using cold caustic extraction, extracting the semi-purified pulp derived from the second brown stock to yield a second purified pulp and a second solution containing hemicellulose.

39. The method of claim 30, wherein said second liquor used in the neutralization of the first batch of organic materials comprises a black liquor.

40. The method of claim 30, wherein the white liquor has an effective alkali concentration of between 95 to 125 grams per liter and the second liquor has an effective alkali concentration of between 30 to 35 grams per liter.

* * * * *